US009310077B2

(12) United States Patent
Breidenthal et al.

(10) Patent No.: US 9,310,077 B2
(45) Date of Patent: Apr. 12, 2016

(54) ACOUSTIC CONTROL OF AN ELECTRODYNAMIC COMBUSTION SYSTEM

(71) Applicant: ClearSign Combustion Corporation, Seattle, WA (US)

(72) Inventors: Robert E. Breidenthal, Seattle, WA (US); Vincenzo Casasanta, III, Woodinville, WA (US); Joseph Colannino, Bellevue, WA (US); David B. Goodson, Bellevue, WA (US); Tracy A. Prevo, Seattle, WA (US); Richard F. Rutkowski, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 291 days.

(21) Appl. No.: 13/956,315

(22) Filed: Jul. 31, 2013

(65) Prior Publication Data

US 2014/0038113 A1 Feb. 6, 2014

Related U.S. Application Data

(60) Provisional application No. 61/678,007, filed on Jul. 31, 2012.

(51) Int. Cl.

| | |
|---|---|
| ***F23N 5/16*** | (2006.01) |
| *F23B 30/00* | (2006.01) |
| *F23N 3/00* | (2006.01) |

(52) U.S. Cl.

CPC ... *F23N 5/16* (2013.01); *F23B 1/00* (2013.01); *F23N 3/00* (2013.01)

(58) Field of Classification Search

CPC ..... F23N 5/16; F23N 3/00; F23B 1/00
USPC ..... 431/2, 1, 114, 18, 19, 350; 73/35.08, 73/35.03

See application file for complete search history.

(56) References Cited

U.S. PATENT DOCUMENTS

| | | | |
|---|---|---|---|
| 1,153,182 | A | 9/1915 | Schniewind |
| 2,604,936 | A | 7/1952 | Kaehni et al. |
| 3,087,472 | A | 4/1963 | Asakawa |
| 3,224,485 | A | 12/1965 | Blomgren et al. |
| 3,306,338 | A | 2/1967 | Wright et al. |

(Continued)

FOREIGN PATENT DOCUMENTS

| | | |
|---|---|---|
| WO | WO 96/01394 | 1/1996 |
| WO | WO 2014/005143 | 1/2014 |

OTHER PUBLICATIONS

Altendrfner et al., "Electric Field Effects on Emissions and Flame Stability With Optimized Electric Field Geometry", Third European Combustion Meeting ECM 2007, p. 1-6.

(Continued)

*Primary Examiner* — Gregory Huson
*Assistant Examiner* — Nikhil Mashruwala
(74) *Attorney, Agent, or Firm* — Christopher A. Wiklof; Nicholas A. Bromer; Launchpad IP, Inc.

(57) ABSTRACT

A system is configured to apply a voltage, charge, and/or an electric field to a combustion reaction responsive to acoustic feedback from the combustion reaction.

18 Claims, 3 Drawing Sheets

(56) References Cited

U.S. PATENT DOCUMENTS

| | | | | |
|---|---|---|---|---|
| 3,358,731 | A | 12/1967 | Donnelly | |
| 3,416,870 | A | 12/1968 | Wright | |
| 3,503,348 | A | 3/1970 | Dvirka | |
| 3,749,545 | A | 7/1973 | Velkoff | |
| 3,841,824 | A | 10/1974 | Bethel | |
| 3,869,362 | A | 3/1975 | Machi et al. | |
| 4,052,139 | A | 10/1977 | Paillaud et al. | |
| 4,091,779 | A | 5/1978 | Saufferer et al. | |
| 4,093,430 | A | 6/1978 | Schwab et al. | |
| 4,110,086 | A | 8/1978 | Schwab et al. | |
| 4,111,636 | A | 9/1978 | Goldberg | |
| 4,118,202 | A | 10/1978 | Scholes | |
| 4,219,001 | A | 8/1980 | Kumagai et al. | |
| 4,260,394 | A | 4/1981 | Rich | |
| 4,304,096 | A | 12/1981 | Liu et al. | |
| 4,340,024 | A | 7/1982 | Suzuki et al. | |
| 4,439,980 | A | 4/1984 | Biblarz et al. | |
| 4,576,029 | A | 3/1986 | Miyake et al. | |
| 4,644,783 | A * | 2/1987 | Roberts et al. | 73/114.07 |
| 4,649,260 | A | 3/1987 | Melis et al. | |
| 4,675,029 | A | 6/1987 | Norman et al. | |
| 4,903,616 | A | 2/1990 | Mavroudis | |
| 4,987,839 | A | 1/1991 | Krigmont et al. | |
| 5,428,951 | A * | 7/1995 | Wilson | F23C 99/00 431/1 |
| 5,702,244 | A | 12/1997 | Goodson et al. | |
| 5,784,889 | A * | 7/1998 | Joos et al. | 60/725 |
| 6,640,549 | B1 | 11/2003 | Wilson et al. | |
| 6,736,133 | B2 | 5/2004 | Bachinski et al. | |
| 6,742,340 | B2 | 6/2004 | Nearhoof, Sr. et al. | |
| 6,918,755 | B1 | 7/2005 | Johnson et al. | |
| 7,137,808 | B2 | 11/2006 | Branston et al. | |
| 7,168,427 | B2 | 1/2007 | Bachinski et al. | |
| 7,182,805 | B2 | 2/2007 | Reaves | |
| 7,226,496 | B2 | 6/2007 | Ehlers | |
| 7,226,497 | B2 | 6/2007 | Ashworth | |
| 7,243,496 | B2 | 7/2007 | Pavlik et al. | |
| 7,377,114 | B1 | 5/2008 | Pearce | |
| 7,523,603 | B2 | 4/2009 | Hagen et al. | |
| 7,845,937 | B2 * | 12/2010 | Hammer et al. | 431/2 |
| 8,082,725 | B2 | 12/2011 | Younsi et al. | |
| 8,245,951 | B2 | 8/2012 | Fink et al. | |
| 8,851,882 | B2 | 10/2014 | Hartwick et al. | |
| 8,881,535 | B2 * | 11/2014 | Hartwick | F23D 14/84 431/8 |
| 2005/0208442 | A1 | 9/2005 | Heiligers et al. | |
| 2007/0020567 | A1 * | 1/2007 | Branston et al. | 431/8 |
| 2010/0183424 | A1 | 7/2010 | Roy | |
| 2011/0203771 | A1 | 8/2011 | Goodson et al. | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 * | 10/2013 | Goodson | 95/3 |
| 2013/0255548 | A1 | 10/2013 | Goodson et al. | |
| 2013/0255549 | A1 | 10/2013 | Sonnichsen et al. | |
| 2013/0260321 | A1 * | 10/2013 | Colannino et al. | 431/2 |
| 2013/0323655 | A1 | 12/2013 | Krichtafovitch et al. | |
| 2013/0323661 | A1 | 12/2013 | Goodson et al. | |
| 2013/0333279 | A1 | 12/2013 | Osier et al. | |
| 2013/0336352 | A1 | 12/2013 | Colannino et al. | |
| 2014/0065558 | A1 | 3/2014 | Colannino et al. | |
| 2014/0190437 | A1 * | 7/2014 | Chiera | F02B 9/10 123/145 A |
| 2014/0208758 | A1 | 7/2014 | Breidenthal et al. | |
| 2014/0287368 | A1 * | 9/2014 | Krichtafovitch | F23N 5/00 431/8 |
| 2014/0338350 | A1 | 11/2014 | Breidenthal | |
| 2015/0107260 | A1 | 4/2015 | Colannino et al. | |
| 2015/0121890 | A1 | 5/2015 | Colannino et al. | |
| 2015/0140498 | A1 | 5/2015 | Colannino | |
| 2015/0147705 | A1 | 5/2015 | Colannino et al. | |
| 2015/0219333 | A1 * | 8/2015 | Colannino | F23C 99/001 431/2 |

OTHER PUBLICATIONS

William T. Brande; "The Bakerian Lecture: On Some New Electro-Chemical Phenomena", Phil. Trans. R. Soc. Lond. 1814 104, p. 51-61.

James Lawton and Felix J. Weinberg. "Electrical Aspects of Combustion". Clarendon Press, Oxford. 1969.

* cited by examiner

ACOUSTIC CONTROL OF AN ELECTRODYNAMIC COMBUSTION SYSTEM

CROSS-REFERENCE TO RELATED APPLICATIONS

The present application claims priority benefit from U.S. Provisional Patent Application No. 61/678,007, entitled "ACOUSTIC CONTROL OF AN ELECTRODYNAMIC COMBUSTION SYSTEM", filed Jul. 31, 2012; which is incorporated by reference in its entirety.

BACKGROUND

Combustion processes can emit broadband acoustic energy caused by turbulent flow, which may be perceived as noise in the form of a "roar" and may be referred to as white noise. Combustion processes can also emit narrowband or discrete frequency noise, which may be referred to as tonal noise. Such white noise and tonal noise may be relevant to issues of combustion performance, the environment, health, and other issues.

SUMMARY

In various embodiments, noise emitted by a combustion system can provide information about a combustion reaction. The information can be used to control a system for applying one or more electric field(s), electrical charge(s), and/or voltage(s) to the combustion reaction. White noise and/or tonal noise emitted by the combustion reaction can be used individually or in combination. The system for applying one or more electric field(s), electrical charge(s), and/or voltage(s) to the combustion reaction can be used to modulate white noise and/or tonal noise, for example, to attenuate the white noise and/or the tonal noise. Additionally or alternatively, the system for applying one or more electric field(s), electrical charge(s), and/or voltage(s) to the combustion reaction can be used to provide other aspects of control to the combustion reaction.

According to an embodiment, a system for applying electricity to a combustion reaction includes a power supply and one or more electrodes operatively coupled to the power supply. The one or more electrodes can be configured to apply an electric field, a charge, a voltage, or a combination thereof to a combustion reaction. An acoustic transducer can be configured to receive an acoustic signal from the combustion reaction and output a corresponding electrical signal. A controller can be operatively coupled to the acoustic transducer and the power supply. The controller can be configured to control one or more outputs from the power supply responsive to the electrical signal from the acoustic transducer.

According to an embodiment, a method for controlling the application of electricity to a combustion reaction uses acoustic feedback from the combustion reaction to determine, at least in part, characteristics of the applied electricity. Applying electricity can include applying a voltage or charge to the combustion reaction, and/or applying an electric field to flue gases or to the combustion reaction. Acoustic feedback is received from the combustion reaction. The voltage, charge, and/or electric field is applied responsive to the acoustic feedback.

Various embodiments include a method for controlling the application of an electric field proximate to a combustion reaction. In some examples, the method can include applying an electric field proximate to the combustion reaction. In several examples, the method can include receiving acoustic feedback from the combustion reaction. In some examples, the method can include modifying the electric field responsive to the acoustic feedback.

According to some embodiments, a non-transitory computer readable medium can carry computer-readable instructions configured to cause an electronic controller to perform steps for controlling the application of electricity to a combustion reaction responsive to receiving acoustic feedback from the combustion reaction. In various examples, the steps include causing a voltage or a charge to be applied to the combustion reaction. In some examples, the steps include receiving acoustic feedback from the combustion reaction. In several examples, the steps include causing the voltage or the charge to be modified responsive to the acoustic feedback.

According to several embodiments, a non-transitory computer readable medium can carry computer-readable instructions configured to cause an electronic controller to perform operations for controlling the application of an electric field to a combustion reaction. In various examples, the steps include causing an electric field to be applied to a combustion reaction. In some examples, the steps include receiving acoustic feedback from the combustion reaction. In several examples, the steps include causing the electric field to be modified responsive to the acoustic feedback.

DETAILED DESCRIPTION

Figure 1:
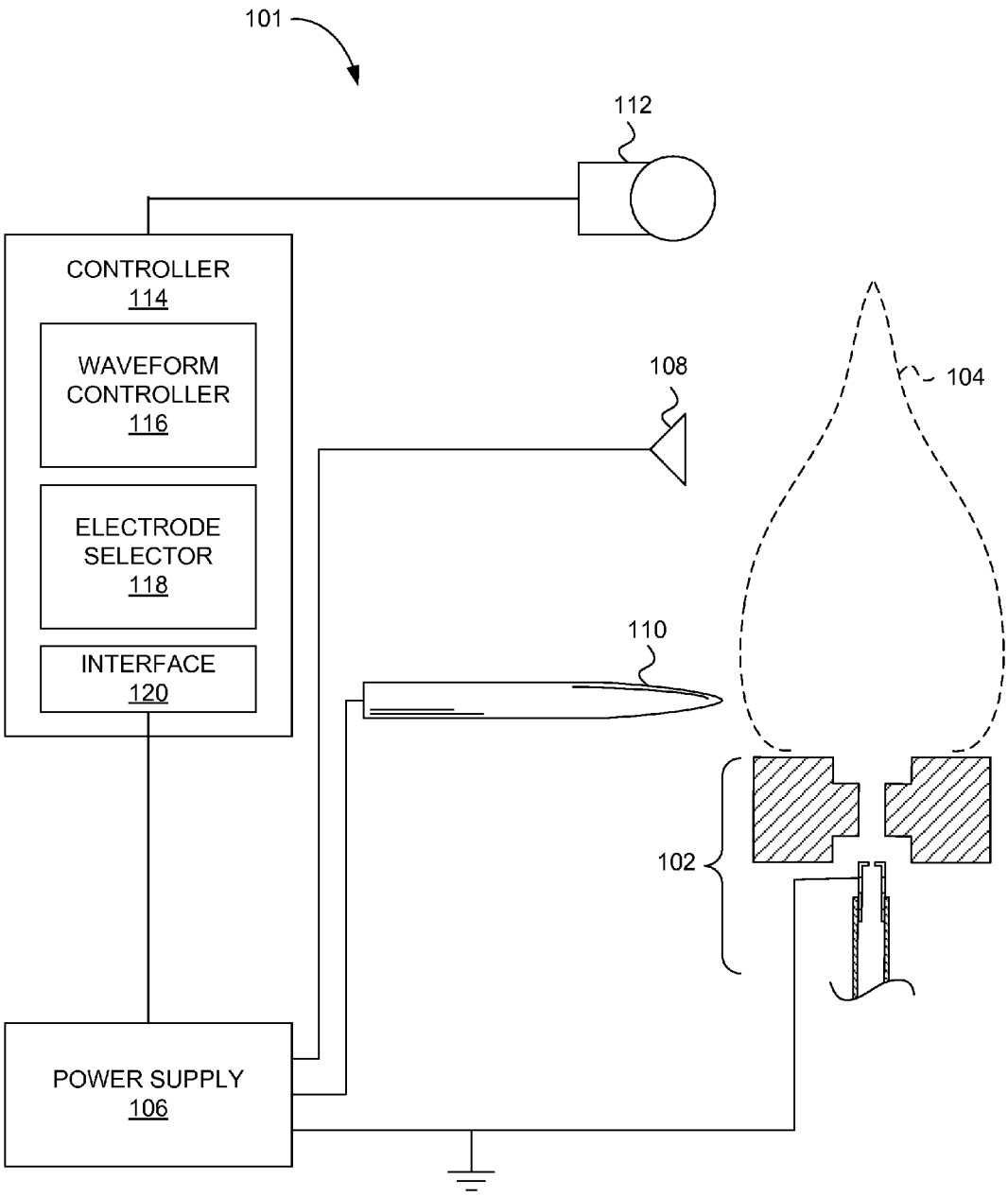
FIG. 1 is a simplified block diagram of a system configured to apply electricity to a combustion reaction and/or to control application of a charge or a voltage to the combustion reaction, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a simplified block diagram of a system 101 configured to apply electricity to a combustion reaction 104 and/or to control application of a charge or a voltage to the combustion reaction 104, according to various embodiments. The system 101 includes a power supply 106. The system 101 also includes one or more electrodes 108 and 110. The one or more electrodes 108 and 110 are operatively coupled to the power supply 106.

In various examples, the one or more electrodes 108 and 110 can be configured to apply an electric field to the combustion reaction 104. In some examples, the one or more electrodes 108 and 110 can be configured to apply a charge to the combustion reaction 104. In several examples, the one or more electrodes 108 and 110 can be configured to apply a voltage to the combustion reaction 104. In many examples, the one or more electrodes 108 and 110 can be configured to apply a combination of two or more of the electric field, the charge, or the voltage to the combustion reaction 104.

In various examples, the system 101 includes an acoustic transducer 112 configured to receive an acoustic signal from the combustion reaction 104. In some examples, the acoustic transducer 112 is configured to output an electrical signal corresponding to the acoustic signal.

In several examples, the system 101 includes a controller 114 that is operatively coupled to the acoustic transducer 112 and the power supply 106. In various examples, the controller 114 can be configured to control one or more outputs from the power supply 106 responsive to the electrical signal output from the acoustic transducer 112.

In various examples, the controller 114 includes a waveform controller 116. The controller 114 can be configured to control a waveform corresponding to the one or more outputs from the power supply 106. The waveform controller 116 is configured to control the waveform responsive to the electrical signal from the acoustic transducer 112.

In some examples, the controller 114 includes an electrode selector 118. The electrode selector 118 can be configured to select one or more electrodes 108 or 110 from a plurality of electrodes 108 and 110 configured for receiving voltage from the power supply 106 responsive to the electrical signal from the acoustic transducer 112.

In several examples, the controller 114 includes an interface 120 configured to output to the power supply 106 at least one signal. In various examples, the interface 120 can be configured to output to the power supply 106 one or more waveform signals. In some examples, the interface 120 can be configured to output to the power supply 106 one or more electrode selection signals. In several examples, the interface 120 can be configured to output to the power supply 106 one or more voltage control signals.

In various examples, the system 101 includes a burner 102 configured to support the combustion reaction 104.

In some examples of the system 101, the combustion reaction 104 includes a flame.

The one or more electrodes 108 or 110 include at least one charge electrode 110 configured to apply a majority charge or a voltage to the combustion reaction 104. In various examples, the power supply 106 can be configured to cause the charge electrode to apply a time-varying majority charge to the combustion reaction 104. In some examples of the system 101, the power supply 106 can be configured to cause the charge electrode to apply a time-varying voltage to the combustion reaction 104.

The one or more electrodes 108, 110 can include at least one field electrode 108 configured to apply one or more electric fields to the combustion reaction 104. The power supply 106 can be configured to cause the at least one field electrode 108 to apply one or more time-varying electric fields to the combustion reaction 104.

In various examples of the system 101, the power supply 106 can be configured to drive the one or more electrodes 108, 110 with one or more periodic voltage waveforms. In some examples, the one or more periodic voltage waveforms can include an alternating current (AC) voltage waveform. The one or more periodic voltage waveforms can include a sinusoidal waveform, a square waveform, a sawtooth waveform, a triangular waveform, a wavelet waveform, a logarithmic waveform, an exponential waveform, or a truncated waveform of any of the waveforms described herein, for example, a truncated triangular waveform. The one or more periodic voltage waveforms can include a combination of any two or more of the waveforms described herein, for example, a combination of the sinusoidal waveform and the square waveform.

In various examples of the system 101, the controller 114 can be configured to control the one or more outputs from the power supply 106 to reduce a white noise and/or a tone noise emitted by the combustion reaction 104 responsive to the electrical signal from the acoustic transducer 112. In some examples, the controller 114 can be configured to control the one or more outputs from the power supply 106 to apply the voltage responsive to the electrical signal from the acoustic transducer 112. In some examples, the controller 114 can be configured to cause the one or more outputs from the power supply 106 to apply one or more voltages proportional to an amplitude of the electrical signal from the acoustic transducer 112. In several examples, the controller 114 can be configured to cause the one or more outputs from the power supply 106 to apply one or more voltages proportional to an amplitude of a white noise component of the electrical signal from the acoustic transducer 112. In many examples, the controller 114 can be configured to cause the one or more outputs from the power supply 106 to apply one or more voltages proportional to an amplitude of a tonal noise component of the electrical signal from the acoustic transducer 112.

In various examples of the system 101, the controller 114 can be configured to determine a combustion reaction rate or a fuel flow rate from the electrical signal from the acoustic transducer 112. In some examples of the system 101, the controller 114 can be configured to select a waveform for output to the one or more electrodes 108, 110. In several examples, the waveform can be configured according to the combustion reaction rate or the fuel flow rate. In many examples, the waveform can include any of the waveforms described herein.

In various examples of the system 101, the controller 114 can be configured to determine a combustion reaction rate or a fuel flow rate from the electrical signal from the acoustic transducer 112. In some examples of the system 101, the controller 114 can be configured to select a voltage for output to the one or more electrodes 108 or 110. In several examples, the voltage can be configured according to the combustion reaction rate or the fuel flow rate.

In various examples of the system 101, the controller 114 can be configured to determine a combustion reaction rate or a fuel flow rate from the electrical signal from the acoustic transducer 112. In some examples of the system 101, the controller 114 can be configured to select a subset of the plurality of electrodes 108 and 110 for driving by the power supply 106. In several examples, the subset of the one or more electrodes 108 and 110 can be configured according to the combustion reaction rate or the fuel flow rate.

Figure 2:
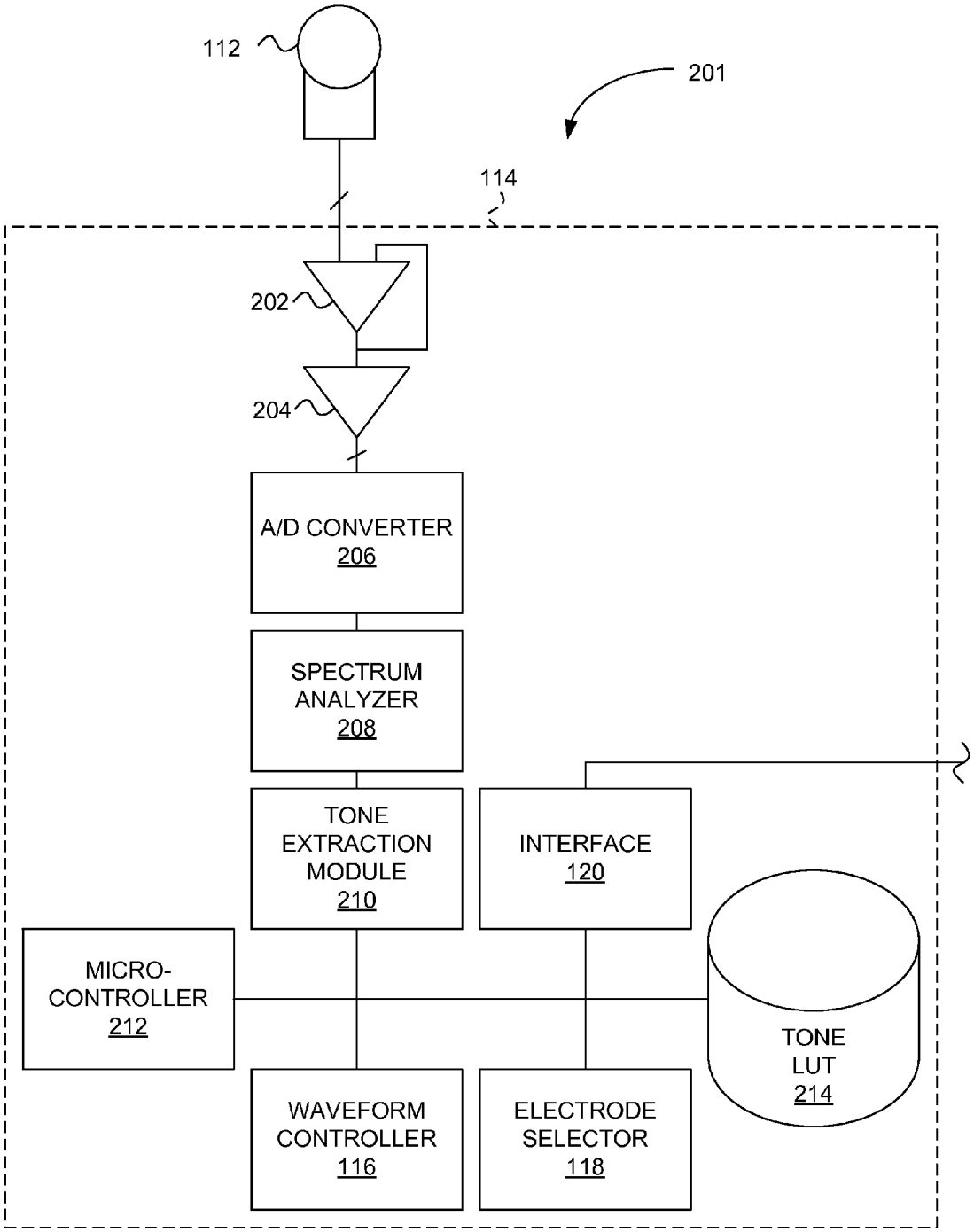
FIG. 2 is a diagram that depicts in more detail various functional components that may be included in the controller, according to an embodiment.

FIG. 2 is a diagram 201 that depicts in more detail various functional components that can be included in the controller 114, according to an embodiment. The acoustic feedback may be continually received from the acoustic transducer 112 to monitor a level and/or other aspect of the white noise and/or the tonal noise generated by the combustion reaction 104.

During operational stages of the system 201, the acoustic transducer 112 converts sound waves from combustion reaction 104 into a corresponding electrical signal. The corresponding electrical signal can be structured as a waveform signal that is expressed as a voltage modulated or resistance modulated signal for further processing by the system controller 114. Processing of the electrical signal in the system controller 114 can include a stage of amplification and/or filtering to adapt the signal amplitude and/or frequency to a resolution bandwidth of the spectrum analyzer 208.

The electrical signal from the acoustic transducer 112 can be received by a high impedance buffer 202, which can optionally be configured as an inverter amplifier. The buffered electrical signal can be passed to an amplifier 204. The amplified electrical signal output by the amplifier 204 can contain one or more bands of frequencies including the white noise and/or the tonal noise from the combustion reaction 104.

If the electrical signal is analog, the filtered electrical signal can be received and processed by an analog to digital (A/D) converter 206. The A/D converter 206 can convert the filtered analog electrical signal into a digital electrical signal at a desired sampling frequency. The A/D converter 206 can be a high-speed A/D converter.

The output from analog/digital converter 206 can be operatively coupled to a spectrum analyzer 208. The spectrum analyzer 208 can include a Fast Fourier Transform (FFT) processor configured to output tonal characteristics of the received audio feedback. For example, the spectrum analyzer 208 can analyze one or more characteristics of the spectrum of the received digital electrical signal, for example, dominant frequency, power, distortion, harmonics, bandwidth, and the like. In some examples, the spectrum analyzer 208 can analyze other spectrum characteristics that may not be easily detected in time-domain waveforms. The analysis can be performed for the characterization of the white noise and/or the tonal noise in the combustion reaction 104. The system controller 114 can enable all the functions suitable for driving the waveform controller 116 and the electrode selector 118.

A tone extraction module 210 can process the digital electrical signal from the spectrum analyzer 208 using algorithms for analyzing characteristics of tonal noise in the digital electrical signal.

A microcontroller 212 can be operatively coupled to one or more components shown in the system diagram 201. The microcontroller 212 can compare the one or more characteristics of the spectrum of the received digital electrical signal of the white noise and/or the tonal noise extracted in the tone extraction module 210. The microcontroller 212 can store the one or more characteristics in a tone level look-up table (LUT) 214. The microcontroller 212 can be programmed to carry out various tasks using a non-transitory computer readable medium carrying computer-readable instructions corresponding to such tasks.

The look-up table 214 can be a database, for example, a relational database that may contain a plurality of acoustic characteristics of the white noise and/or the tonal noise. The extracted white noise and/or tonal noise can be input to the look-up table 214 to access one or more instructions for the microcontroller 212, and/or one or more waveforms for loading into a waveform generator (not shown). For example, the one or more looked-up instructions can cause the microcontroller 212 to drive the waveform controller 116 and the electrode selector 118 to apply a voltage, a charge, and/or an electric field to the combustion reaction 104, through the one or more electrodes 108 and 110, and/or a combination thereof. In addition, the microcontroller 212 can drive the waveform controller 116 and the electrode selector 118 to modify the voltage, the charge, and/or the electric field responsive to the electrical signal received from the acoustic transducer 112.

The system controller 114 can output at least one function from the interface 120 to the power supply 106. The at least one function can include one or more waveform signals, one or more electrode selection signals, and/or one or more voltage control signals. The at least one function can attenuate the white noise and/or the tonal noise in the combustion reaction 104. Additionally or alternatively, the at least one function can control the voltage(s) to which the electrode(s) can be driven.

Figure 3:
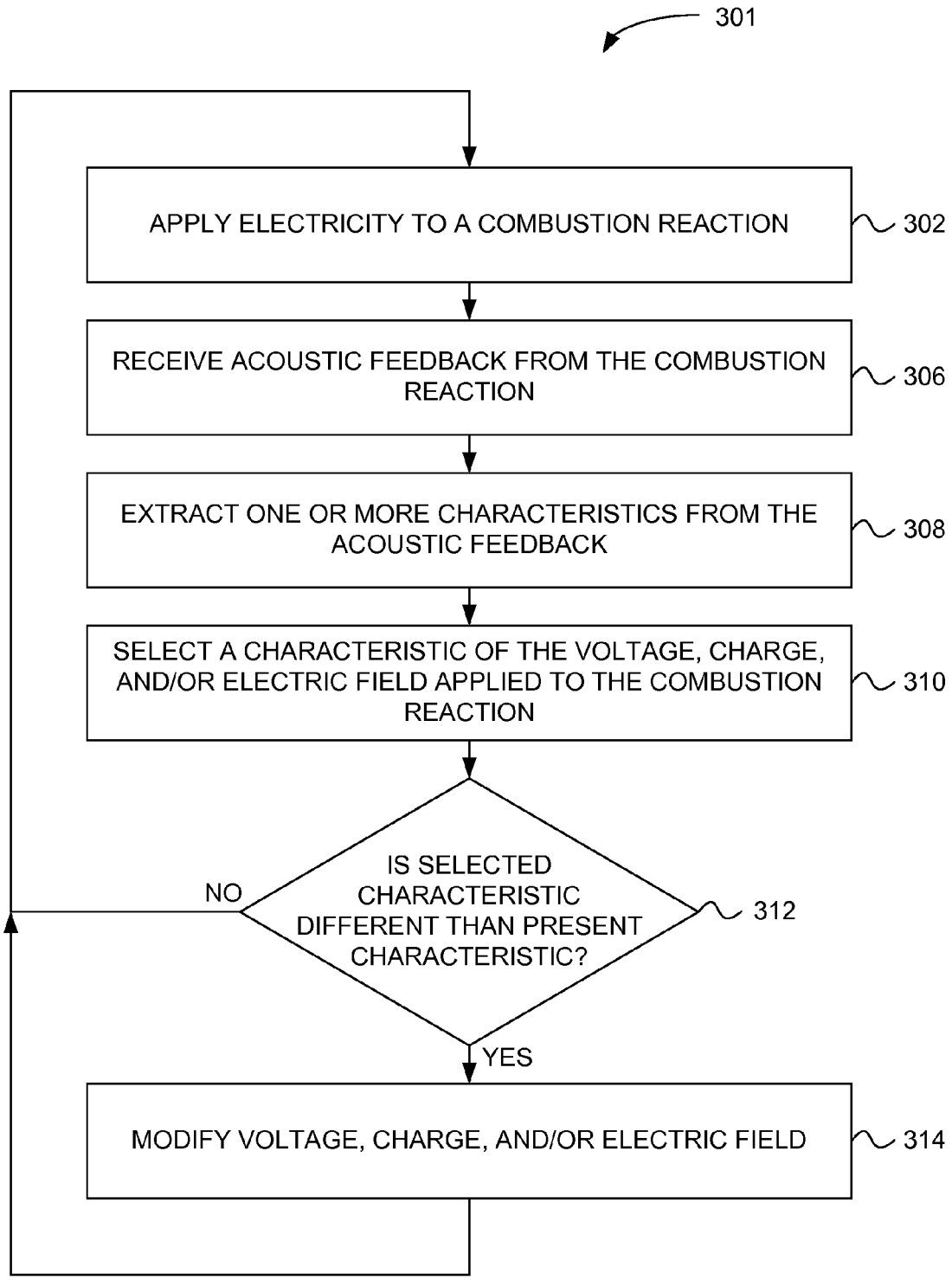
FIG. 3 is a flow chart showing a method for using acoustic feedback to control application of one or more of the electric field, the charge, and/or the voltage to the combustion reaction, according to various embodiments.

FIG. 3 is a flow chart showing a method 301 for using acoustic feedback to control application of one or more of a electric field, a charge, and/or a voltage to a combustion reaction, according to an embodiment.

In step 302, electricity is applied to a combustion reaction. As will be seen below, the electricity can be a function of audio feedback from the combustion reaction. At start up, or if audio feedback is not required, characteristics of the applied electricity can be determined according to a predetermined set of operating parameters. For example, the operating parameters can be selected for minimization of audible noise output by the combustor. Frequently, audible noise can be minimized by selecting characteristics of the applied electricity to minimize resonant responses of the combustor. For example, an electricity modulation frequency (e.g., AC frequency) can be selected not to match (including overtone and undertone non-matching) a known resonant (e.g., excitation) frequency of the combustor. In some embodiments, the electrical modulation can be selected to act as active sound attenuation. In another example, the electricity modulation frequency can be frequency-diversified to minimize energy output at a known or unknown resonant frequency of the combustor. In one embodiment the electricity is modulated according to a spread spectrum. For example, in a frequency-hopping spread spectrum electrical modulation, the electrical modulation is made with a changing frequency that is swept through (or through overtones or undertones of) of audible frequencies at which the combustor could resonate.

As described above, applying electricity to the combustion reaction in step 302 can include applying voltage or charge to the combustion reaction, and/or can include applying an electric field to the combustion reaction. An applied electric field can be selected to interact with voltage or the charge applied to the combustion reaction. In various examples of the method 301, the combustion reaction includes a flame.

Proceeding to step 306, acoustic feedback is received from the combustion reaction. In step 314, the voltage, charge, and/or electric field is modified responsive to the acoustic feedback.

Various examples of the method 301 include step 308 wherein one or more acoustic characteristics are extracted from the acoustic feedback. In some examples, the one or more acoustic characteristics can include one or more tones. In several examples, the one or more acoustic characteristics can include an acoustic energy magnitude.

In various examples, step 314 includes changing a voltage or charge modulation frequency or an electric field modulation frequency to attenuate the one or more tones detected from the combustor. In several examples, step 314 can include changing a voltage or a charge concentration. Additionally or alternatively, step 314 can include compensating for a change in a combustion reaction volume, an air flow rate, and/or a fuel flow rate. Additionally or alternatively, step 314 can include changing a waveform shape corresponding to the voltage or charge and/or to the applied electric field.

Various examples of the method 301 include step 310, wherein a characteristic of a voltage or a charge applied to the combustion reaction is selected responsive to (and/or corresponding to) the acoustic feedback. Some examples of the method 301 include step 312 where it is determined if the selected characteristic of the voltage or the charge applied to the combustion reaction is different from a present characteristic of the voltage or the charge applied to the combustion reaction. In several examples in step 314 the voltage or the charge responsive to the acoustic feedback is modified when the selected characteristic is different from the present characteristic.

In various examples of the method 301, the voltage or the charge can include a time-varying voltage or a time-varying charge.

In many examples of the method 301, step 314 can include changing a voltage modulation frequency or a charge modulation frequency to attenuate the one or more tones.

In some examples, step 314 can include changing a voltage magnitude.

In several examples, step 314 can include changing a waveform shape corresponding to the electric field.

In various examples, step 314 can include changing an electrode or a location of the electrode applying the electric field.

In some examples, step 314 can include compensating for a change in a combustion reaction volume, an air flow rate, and/or a fuel flow rate.

In various examples of the method 301 step 310 can include determining a desired characteristic of an electric field applied proximate to the combustion reaction responsive to the acoustic feedback.

In various examples of the method 301, the electric field can include a time-varying electric field.

Various examples of the method 301 can include monitoring of the white noise and/or the tonal noise that is associated with the combustion reaction. In some examples, the method 301 can continuously monitor the white noise and/or the tonal noise. In various examples, the method 301 can be implemented by the system controller. In various examples, the method 301 can monitor the white noise and/or the tonal noise during the start-up, loading, and/or stopping of a combustion system. The method 301 can incorporate an iterative procedure that successively attenuates the level of the white noise and/or the tonal noise in the combustion reaction.

Additionally or alternatively, the method 301 can use acoustic feedback to determine an electrode modulation frequency hopping period, a hopping sub-band sequence, and/or a hopping sub-band exclusion. The electrode modulation frequency-hopping period, a hopping sub-band sequence, and/or a hopping sub-band exclusion can be useful, for example, in a system configured to modulate the one or more electrodes and according to a spread spectrum logic. For example, a given electrodynamic combustion system can exhibit acoustic resonance (which may, for example, be associated with organ modes), and the method 301 can cause the system to avoid resonant frequencies and/or can reduce energy output at resonant frequencies.

Additionally or alternatively, the method 301 can use acoustic feedback to determine a combustion reaction characteristic, for example to drive the one or more electrodes or in a manner corresponding to the reaction characteristic. For example, the white noise can increase monotonically with the fuel flow rate. The white noise can be detected and used to select for one or more electrodes voltage(s), a duty cycle, a waveform, a current, or any other characteristic that corresponds to the fuel flow rate. Additionally or alternatively, the burner can tend to output tonal energy as a function of the fuel flow rate. Tonal analysis can similarly be used to select parameters for one or more electrodes.

In various examples, a non-transitory computer readable medium can carry computer-readable instructions configured to cause an electronic controller to perform steps for controlling the application of a voltage or a charge to a combustion reaction. In some examples, the steps can include causing a voltage or a charge to be applied to a combustion reaction. In several examples, the steps can include receiving acoustic feedback from the combustion reaction. In other examples, the step can include causing the voltage or the charge to be modified responsive to the acoustic feedback.

In various examples, a non-transitory computer readable medium can carry computer-readable instructions configured to cause an electronic controller to perform steps for controlling the application of an electric field to a combustion reaction. In some examples, the steps can include causing an electric field to be applied to a combustion reaction. In several examples, the steps can include receiving acoustic feedback from the combustion reaction. In many examples, the steps can include causing the electric field to be modified responsive to the acoustic feedback.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system for applying electricity to a combustion reaction, comprising:

a power supply;

one or more electrodes that are:

operatively coupled to the power supply; and configured to apply an electric field, a charge, a voltage, or a combination thereof to the combustion reaction;

an acoustic transducer configured to receive an acoustic signal from the combustion reaction and output an electrical signal corresponding to the acoustic signal; and a controller that is:

operatively coupled to the acoustic transducer and the power supply; and configured to control one or more outputs from the power supply to the one or more electrodes responsive to the electrical signal output from the acoustic transducer;

wherein the controller includes an electrode selector configured to select one or more electrodes from a plurality of electrodes, responsive to the electrical signal from the acoustic transducer.

2. The system for applying electricity to the combustion reaction of claim 1, wherein the controller includes a waveform controller configured to control a waveform corresponding to the one or more outputs from the power supply, wherein the waveform controller is configured to control the waveform responsive to the electrical signal from the acoustic transducer.

3. The system for applying electricity to the combustion reaction of claim 1, wherein the controller includes an interface configured to output to the power supply at least one signal selected from the group consisting of:

one or more waveform signals, one or more electrode selection signals, and one or more voltage control signals.

4. The system for applying electricity to the combustion reaction of claim 1, further comprising a burner configured to support the combustion reaction.

5. The system for applying electricity to the combustion reaction of claim 1, wherein the combustion reaction includes a flame.

6. The system for applying electrical energy to the combustion reaction of claim 1, wherein the one or more electrodes includes at least one charge electrode configured to apply a majority charge or a voltage to the combustion reaction.

7. The system for applying electrical energy to the combustion reaction of claim 6, wherein the voltage source is configured to cause the charge electrode to apply a time-varying majority charge or a time-varying voltage to the combustion reaction.

8. The system for applying electricity to the combustion reaction of claim 1, wherein the one or more electrodes includes at least one field electrode configured to apply one or more electric fields to the combustion reaction.

9. The system for applying electricity to the combustion reaction of claim 8, wherein the power supply is configured to cause the at least one field electrode to apply one or more time-varying electric fields to the combustion reaction.

10. The system for applying electricity to the combustion reaction of claim 1, wherein the power supply is configured to drive the one or more electrodes with one or more periodic voltage waveforms.

11. The system for applying electricity to the combustion reaction of claim 10, wherein the one or more periodic voltage waveforms includes at least one of an alternating current (AC) voltage waveform, a sinusoidal waveform, a square waveform, a sawtooth waveform, a triangular waveform, a wavelet waveform, a logarithmic waveform, an exponential waveform, a truncated waveform, or a combination waveform thereof.

12. The system for applying electricity to the combustion reaction of claim 1, wherein the controller is configured to control the one or more outputs from the power supply to reduce a white noise and/or a tone noise emitted by the combustion reaction responsive to the electrical signal from the acoustic transducer.

13. The system for applying electricity to the combustion reaction of claim 1, wherein the controller is configured to control the one or more outputs from the power supply to apply the voltage responsive to the electrical signal from the acoustic transducer.

14. The system for applying electricity to the combustion reaction of claim 13, wherein the controller is configured to cause the one or more outputs from the power supply to apply one or more voltages proportional to an amplitude of the electrical signal from the acoustic transducer.

15. The system for applying electricity to the combustion reaction of claim 13, wherein the controller is configured to cause the one or more outputs from the power supply to apply one or more voltages proportional to an amplitude of a white noise component of the electrical signal from the acoustic transducer and/or a tonal noise component of the electrical signal from the acoustic transducer.

16. The system for applying electricity to the combustion reaction of claim 1, wherein the controller is configured to:

determine at least one of a combustion reaction rate and a fuel flow rate from the electrical signal from the acoustic transducer; and select a waveform for output to the one or more electrodes, the waveform being configured according to the combustion reaction rate or the fuel flow rate.

17. The system for applying electricity to the combustion reaction of claim 1, wherein the controller is configured to:

determine at least one of a combustion reaction rate and a fuel flow rate from the electrical signal from the acoustic transducer; and select a voltage for output to the one or more electrodes, the voltage being configured according to the combustion reaction rate or the fuel flow rate.

18. The system for applying electricity to the combustion reaction of claim 1, wherein the controller is configured to:

determine at least one of a combustion reaction rate and a fuel flow rate from the electrical signal from the acoustic transducer; and select a subset of a plurality of electrodes for driving by the power supply, the subset of the plurality of electrodes being configured according to the combustion reaction rate or the fuel flow rate.

* * * * *